US005482111A

United States Patent [19]

Bizard

[11] Patent Number: 5,482,111

[45] Date of Patent: Jan. 9, 1996

[54] INSTALLATIONS FOR CLEANING TUBES BY CIRCULATING SPONGY BALLS, IN PARTICULAR IMPROVEMENTS RELATING TO IMPREGNATING THE BALLS WITH WATER

[75] Inventor: André Bizard, Paris, France

[73] Assignee: Technos et Compagnie, Suresnes, France

[21] Appl. No.: 262,530

[22] Filed: Jun. 20, 1994

[30] Foreign Application Priority Data

Jun. 22, 1993 [FR] France ..... 93 07547

[51] Int. Cl.[6] ..... F28G 1/12

[52] U.S. Cl. ..... 165/95; 15/3.5

[58] Field of Search ..... 165/95; 15/3.5, 15/3.51, 104.062

[56] References Cited

U.S. PATENT DOCUMENTS

| | | | |
|---|---|---|---|
| 3,872,920 | 3/1975 | Honma et al. | 165/95 |
| 3,919,732 | 11/1975 | Honma et al. | 15/3.51 |
| 4,420,038 | 12/1983 | Okouchi et al. | 165/95 |
| 4,554,965 | 11/1985 | Bochinski | 165/95 |
| 4,569,097 | 2/1986 | Echols | 15/104.06 |
| 4,984,629 | 1/1991 | Voith et al. | 165/95 |
| 5,176,204 | 1/1993 | Ben-Dosa | 165/95 |

FOREIGN PATENT DOCUMENTS

| | | | |
|---|---|---|---|
| 3125493 | 4/1982 | Germany . | |
| 14198 | 1/1982 | Japan | 165/95 |
| 14190 | 1/1982 | Japan | 165/95 |
| 19598 | 2/1982 | Japan | 165/95 |
| 144898 | 9/1982 | Japan | 165/95 |
| 124198 | 7/1983 | Japan | 165/95 |
| 128098 | 6/1986 | Japan | 165/95 |

*Primary Examiner*—Leonard R. Leo
*Attorney, Agent, or Firm*—Larson and Taylor

[57] ABSTRACT

To impregnate with water the spongy balls (1) that are to be used for cleaning the tubes of a condenser, the balls are put into a tank (2) whose upper portion forms a chamber (10) that is separated from the remainder of the tank by a grid (9) to which the balls cannot pass, the chamber is connected to a pump (17) having a piston (19), and then after the tank and the volumes in communication therewith have been filled with water, all of the valves giving access to the tank are closed, the piston of the pump is pulled back, thereby causing air to be expelled from the balls in the chamber, and the volume is again completely refilled with water so as to evacuate said air and impregnate the balls with water.

7 Claims, 2 Drawing Sheets

INSTALLATIONS FOR CLEANING TUBES BY CIRCULATING SPONGY BALLS, IN PARTICULAR IMPROVEMENTS RELATING TO IMPREGNATING THE BALLS WITH WATER

It is known that permanent cleaning of the inside surfaces of tubes in condensers or heat exchangers can be performed by causing continuous circulation within said tubes of a flow of water carrying resilient balls made of a spongy material.

The spongy balls must be impregnated with water before being put into service.

The purpose of impregnating them is to expel the air contained in the open cells of the spongy structure of the balls so as to impart an apparent density to the balls that is very close to that of water: if the air is not expelled from the balls, then the balls would be lighter than water and they would tend to float, thereby cleaning only the top portions of the generally horizontal tubes in the condenser or the like.

The balls are usually impregnated by hand by kneading the balls under water before injecting them into the cleaning closed circuit that includes the tubes to be cleaned.

This manual operation is lengthy and fiddly. It becomes difficult or even dangerous when the balls are of the "abrasive" type containing particles that have sharp edges.

Proposals have also been made for a method of automatically impregnating balls with water by inserting the balls to be impregnated into a tank connected to a vacuum pump via a grid having a mesh that is too small to allow the balls to pass therethrough, said pump serving to evacuate the air contained in the balls and to impregnate them with water (see documents U.S. Pat. No. 3,872,920 and U.S. Pat. No. 4,420,038).

That solution is difficult to implement, in particular because of the need to provide means for separating the air and the water that are sucked in simultaneously and because of the frequent presence of debris in the water that surrounds the balls, which debris clogs up or damages certain small-section components of the vacuum system.

Very generally, the invention relates to tube cleaning installations as defined above and more particularly, but not exclusively, to methods and apparatuses for impregnating water into the cleaning balls used in such installations.

Above all, an aim of the invention is to make such methods and apparatuses capable of remedying the drawbacks mentioned above by proposing a solution that is both effective and robust, and that lends itself to automation with a high degree of security, thereby making it possible to achieve a corresponding reduction in the maintenance and surveillance costs and care required by the corresponding cleaning installations.

To this end, apparatuses of the kind in question and for impregnating balls of the invention still comprise a tank interposed between first and second valves associated respectively with a water inlet duct and with a water outlet duct, a coupling provided with a third valve connecting the top of the tank to a source of new cleaning balls, a grid having a mesh that is too small to allow the balls to pass disposed inside the tank in such a manner as to define a chamber at the top of the tank which is inaccessible to the balls, a duct fitted with a fourth valve connecting said chamber to an outlet, and a device suitable for generating a pressure reduction in said chamber, and they are essentially characterized in that the device for generating a pressure reduction is constituted by a pump having a piston or the like in which one of two compartments separated by the piston or the like communicates with the chamber in such a manner that each go-and-return stroke of the piston successively increases by a well-determined quantity the volume defined by the inside of the tank and by the spaces in communication with said inside when the four above-mentioned valves serving the tank are all closed, and then cancels said increase.

As for methods of impregnation that implement the above apparatuses, they are essentially characterized, according to the invention, by the following sequence of steps: with the first two valves closed and the other two valves open, a charge of new balls is inserted into the tank through the third valve; then, with the second and third valves closed and with the other two valves open, water is admitted into the tank until it has been completely filled with water; then, with all four valves closed, the piston or the like is actuated in the direction corresponding to increasing the volume that is in communication with the inside of the tank, thereby subjecting said volume to a reduction in pressure and expelling from the balls at least part of the air contained therein, which air is collected in the upper chamber of the tank and in the capacity in communication with said chamber; after which the first and fourth valves are opened so as to fill all of the volumes in question with water, thereby impregnating with water the balls that have been at least partially emptied of air, and the piston or the like is actuated in the direction opposite to the preceding direction to return it to its initial position, the cycle of the two above-defined steps implementing a go-and-return stroke of the piston or the like optionally being repeated one or more times.

In advantageous embodiments, use is made of one or more of the following dispositions:

- if the volume of the cylinder capacity of the pump is written V and if the volume at atmospheric pressure of the air contained in the cells of the charge of balls inserted into the tank is written M, then V is given a value that is greater than $4v$;
- the pump is constituted by a diaphragm pump whose moving member constitutes the bottom of the tank;
- the upper chamber inside the tank has, passing through it, a vertical chimney that is laterally defined by a grid, the chimney extending downwards the coupling between the tank and the third valve, and a float is disposed beneath said chimney in such a manner to prevent the balls contained in the tank from moving back up inside said chimney;
- the apparatus comprising the tank, the pump, and the associated pipework and valves serving them is connected in parallel with the pipework for recycling the balls for cleaning the tubes of a condenser or similar, which pipework extends from the outlet of the condenser to the inlet thereof; and
- in an installation according to the preceding paragraph, the apparatus comprising the tank, the pump and the associated pipework and valves serving them is associated with a ball counter and with a ball sorter, as taught in document U.S. Pat. No. 4,974,662, in such a manner that any removal of a charge of worn balls from the installation is compensated by insertion into said installation of an equivalent charge of new balls impregnated with water, and the operation of the assembly is automated.

Apart from the above main dispositions, the invention includes certain other dispositions that are preferably used simultaneously therewith and that are described in greater detail below.

Various preferred embodiments of the invention are described below with reference to the accompanying drawings, naturally in a manner that is not limiting.

Figure 1:
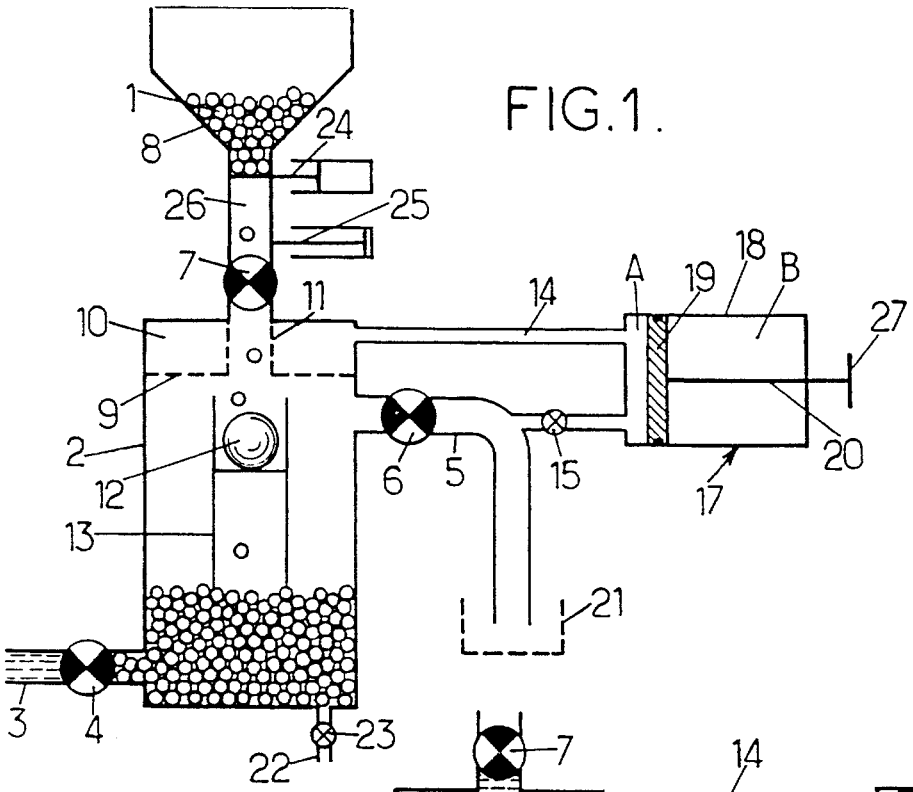
FIGS. 1 to 3 are diagrams of apparatus established in accordance with the invention and enabling cleaning balls to be impregnated with water, said apparatus being shown respectively in three different stages of operation.
Figure 2:
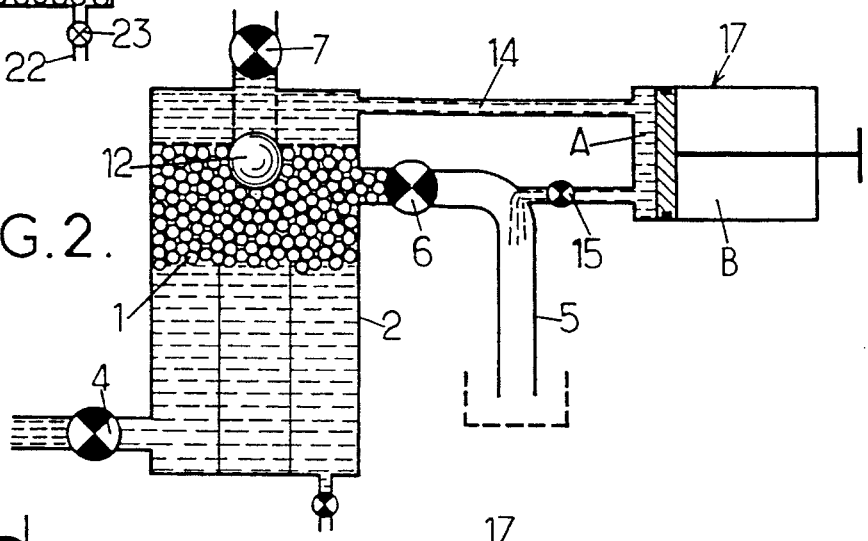
Figure 3:
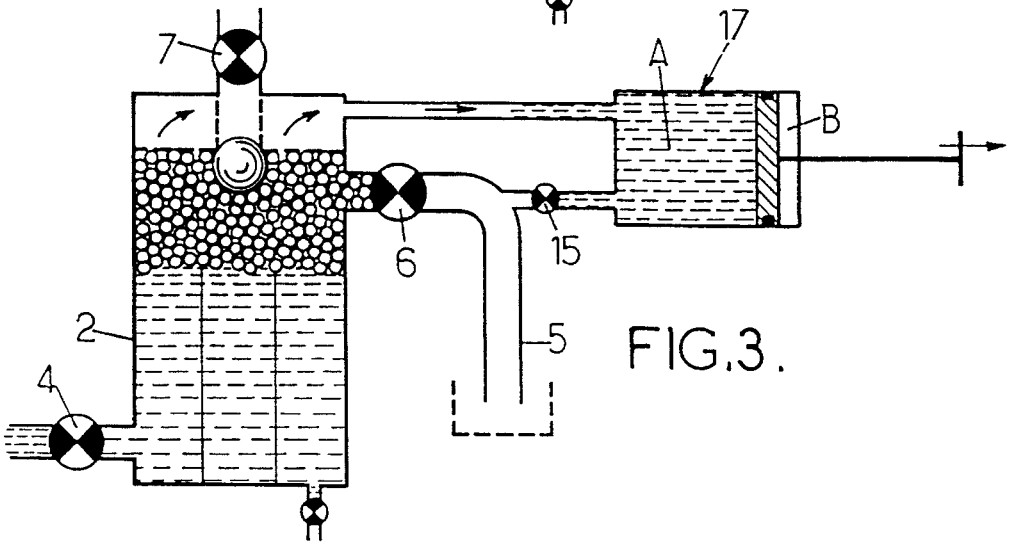

The apparatus shown in FIGS. 1 to 3 comprises a tank 2 serviced in the vicinity of its base by a water inlet duct 3 fitted with a first valve 4, and in the vicinity of its top, with a water outlet duct 5 fitted with a second valve 6.

The top of the tank 2 is connected via a third valve 7 to a hopper 8 for receiving new balls 1.

The top portion of the tank 2 has a horizontal grid 9 extending thereacross and defining an enclosure 10 above The enclosure 10 itself has a vertical chimney passing through it, that is laterally defined by a cylindrical grid 11, putting the coupling for the hopper 8 fitted with the valve 7 into communication with the inside of the tank 2.

The mesh of the grid elements 9 and 11 is small enough to prevent the balls 1 from passing through them and large enough to ensure that water passing through the mesh is subjected to no more than negligible head loss.

A float 12, e.g. constituted by a hollow ball filled with air, is disposed in a lightweight guide structure 13 constituted in particular by metal rods, immediately below the bottom outlet from the grid chimney 11 so as to enable said outlet to be left open while the ball is in its normal rest position as shown in FIG. 1, and, in contrast, so as to close said outlet when the balls is in its high position shown in FIGS. 2 and 3.

Such closure prevents any balls going back up the chimney 11 during the water impregnation process, which balls could then be incompletely impregnated with water.

The enclosure 10 can be connected to the atmosphere, or more precisely to an exhaust duct, via a duct 14 fitted with a fourth valve 15.

A pump 17 comprising in this case a cylinder 18 and a piston 19 having a rod 20 is put into communication with the tank 2 in the following manner: one chamber A of the two chambers A and B of the cylinder 18 that are separated by the piston 19 is directly connected to the portion of the duct 14 which lies between the tank 2 and the valve 15.

The portion of the duct 14 downstream from the valve 15 is, in this case, directly connected to the outlet duct 5, which duct opens out downwards into a collection basket 21.

FIG. 1 also shows:

- a bleeder duct 22 connected to the bottom of the tank 2 and fitted with a valve 23;
- two slide mechanisms 24 and 25 between the valve 7 and the base of the hopper 8 and suitable for defining between them, when in a closure position, a space 26 of well-determined volume, which volume may be used for accurately measuring out the charges of balls injected into the tank 2; and
- a handle 27 terminating the piston rod 20 of the pump 17 and enabling said piston rod to be driven by hand.

The apparatus as described above operates as follows.

Initially, the tank 2 is empty in the sense that it contains no water and no balls, and the valves 4, 6, and 23 are closed.

The charge of balls 1 to be impregnated with water is then injected into the tank 2 via the open valve 7 and the chimney 11.

The top of the charge of balls thus injected into the tank 2 must not be higher than the base of the float 12.

The valve 7 is then closed and the two valves 4 and 15 are opened.

Water is then injected into the tank 12 and the level of said water rises inside said tank with the air contained therein escaping via the duct 14, the open valve 15, and the duct 5.

As the level of water rises inside the tank, the float 12 rises together with the balls and it closes the bottom of the chimney 11.

Once the entire volume inside the tank 2, including the volume of the upper enclosure 10 and the volume of the duct 14 as far as the valve 15 has been all filled with water, as shown in FIG. 2, the two valves, 4 and 15 are closed, thereby defining a capacity that is fully closed and filled with water and in which the balls 1 still containing air are fully immersed.

The handle 27 is then pulled so as to reduce the pressure inside the above-defined capacity, thereby expelling a fraction of the air contained in the balls, as can be seen in FIG. 3.

This air rises to the top portion of the tank 2 and collects inside the enclosure 10 and the chimney 11, with the balls being prevented from gaining access to said enclosure and chimney.

After enough time has elapsed to ensure that the air contained in the balls has been expelled into the enclosure 10, the valve 4 is opened, thus admitting a new volume of water into the tank 2, which volume impregnates the balls 1 that have been at least partially emptied of their initial air.

Simultaneously with this opening of the valve 4, or slightly later, the valve 15 is opened to expel the air from the circuit and to make it possible to refill completely the capacities with water.

Then, using the handle 27, the piston 19 is pushed back towards its initial position, with the excess water being evacuated through the valve 15.

At the end of this cycle, the balls will still be incompletely impregnated with water if the cylinder capacity of the pump, i.e. the volume of air or water displaceable in the chamber A on each full go-and-return stroke of the piston 19, is insufficient relative to the volume of water with which it is desired to impregnate the balls.

The balls are then fully impregnated by performing a second cycle of operations identical to the first after closing the two valves 4 and 15.

If the volume of water which it is desired to inject into the balls is large relative to the cylinder capacity of the pump 17, then impregnating said balls may require more than two successive cycles.

The number of cycles required may be determined as follows.

Let v be the volume, at atmospheric pressure, of the air contained in the cells in the charge of balls to be impregnated and let V be the cylinder capacity of the pump 17, then the pressure P expressed in bars absolute that obtains inside the tank 2 when the piston 19 has finished moving back to the position shown in FIG. 3 is given by the following equation:

$$P(V+v)=1.v \quad (1)$$

In practice, it is observed that it is necessary for the pressure P to be less than 0.2 bars to ensure that the balls are sufficiently impregnated, i.e. to ensure that their apparent density is close enough to that of water.

It can thus be deduced that complete impregnation of the balls can be performed in a single cycle if the charge of balls admitted is such that the pressure P after the first suction stroke of the piston is less than 0.2 bars, i.e. if the volume V is greater than $4v$.

Otherwise, it is necessary to perform at least one second cycle of operations during which the pressure P' obtained in the tank after the new suction stroke of the piston 19 to the position shown in FIG. 3 is given by the following equation:

$$P'(V+v')=1.v' \quad (2)$$

in which equation v' is the volume at atmospheric pressure of the air remaining in the cells of the charge of balls at the end of the most recently performed cycle.

Since the quantity v' can be calculated by the following equation:

$$(v-v')(v+V)=vV \quad (3)$$

it is possible to deduce the value of P' as a function of V and of v from above equation (2).

If this value is still greater than 0.2 bars, then it is necessary to perform a third cycle, and so on.

It follows from the above that the balls injected into the tank 2 are not properly impregnated with water unless the volume of air that they contain initially is less than or equal to the maximum acceptable volume calculated as a function of the cylinder capacity V of the pump and the number of cycles performed thereby.

To avoid running the risk of exceeding this threshold, it is recommended that each charge of new balls injected into the tank for the purpose of being impregnated is measured out accurately: this is the role performed by the slides 24 and 25 that define the air lock 26 of well-defined volume, as described above.

Naturally, stirring means may be provided in the hopper 8 or on the hopper to ensure that the balls drop down under gravity alone into the air lock 26 as soon as the upper slide 24 is opened, with said opening optionally being subject to the lower slide 25 being closed.

When a charge of balls 1 injected into the tank 2 has been sufficiently impregnated with water, then the charge is evacuated by means of a flow of water through the open valve 6 and the duct 5, and it is connected in the basket 21.

Figure 5:
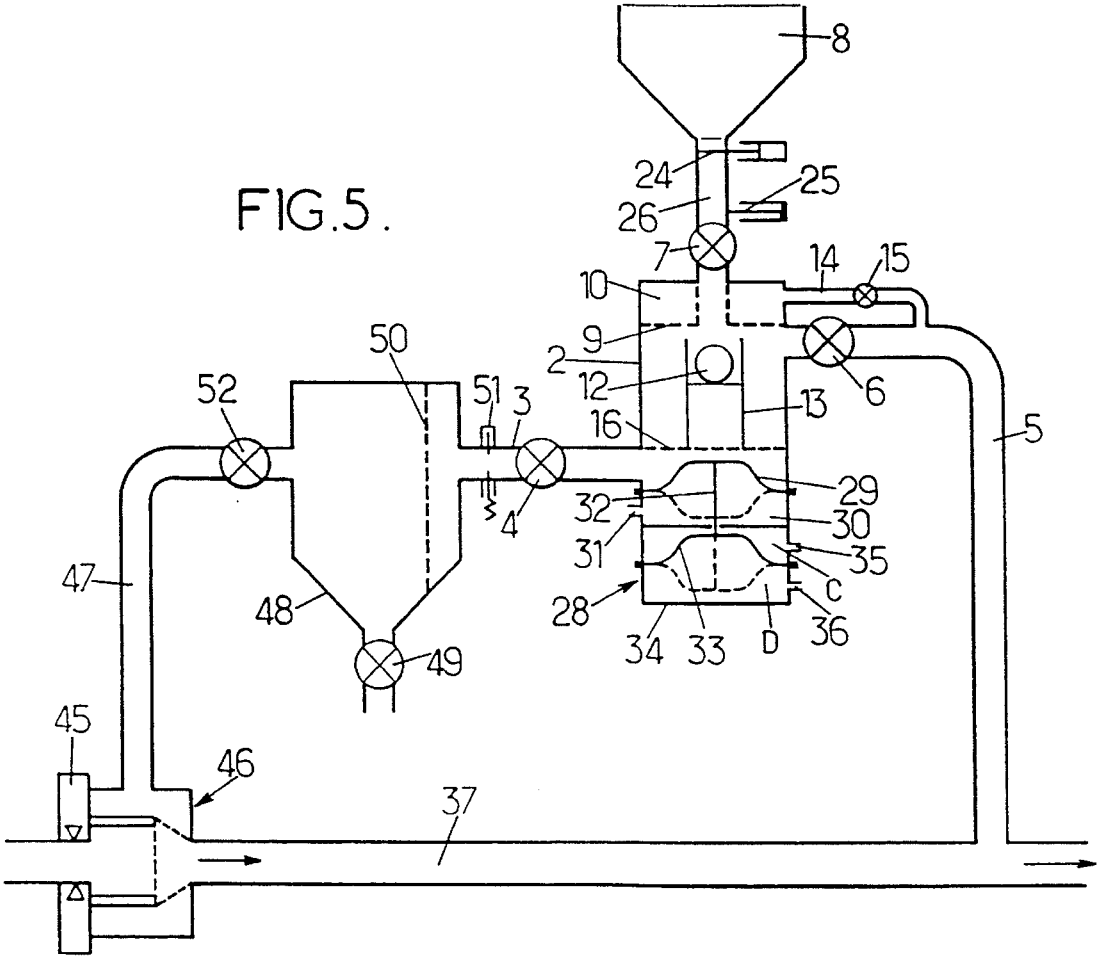
FIG. 5 is a diagram showing firstly a preferred structure for the impregnation apparatus proposed in accordance with the invention, and secondly the preferred association of said apparatus with other accessories that are known The balls 1 to be impregnated with water are balls made of sponge rubber having open pores.

The righthand portion of FIG. 5 shows another structure for the above-described impregnator apparatus.

In this other structure, elements that are identical or analogous to those described above are given the same references as before.

The main differences between this other structure and the preceding structure are as follows:

- in this case, the pump is constituted by a diaphragm pump 28 and the deformable diaphragm 29 of said pump itself constitutes the bottom of the tank 2;
- a chamber 30 disposed beneath said diaphragm 29 is connected to the outside atmosphere at 31; and
- the diaphragm 29 is connected by means of a rod 32 which passes in sealed manner through the bottom of the chamber 30 to a second flexible diaphragm 33 that is identical and that subdivides a bottom housing 34 into two compartments C and D suitable for being connected individually and alternately to a source of compressed air and to the atmosphere, respectively through two couplings 35 and 36.

The structure 13 for supporting and guiding the float 12 is supported in this case by a grid 16 that extends across the inside of the tank 2 a little above the diaphragm 29.

Like the grid 9, the grid 16 is organized to prevent balls from passing through it.

Finally, there is no capacity in this case comparable to the compartment A of the above pump 17 on the length of duct 14 between the chamber 10 and the evacuation duct 5.

This embodiment operates in exactly the same manner as the preceding embodiment, with manual control of the handle 27 being replaced in this case by vertical displacements of the diaphragm 29 itself controlled by putting each of the two compartments C and D into alternating communication with a source of compressed air, with each of such connections of one or other of the two compartments being synchronized with the other compartment being put into communication with the outside atmosphere.

Figure 4:
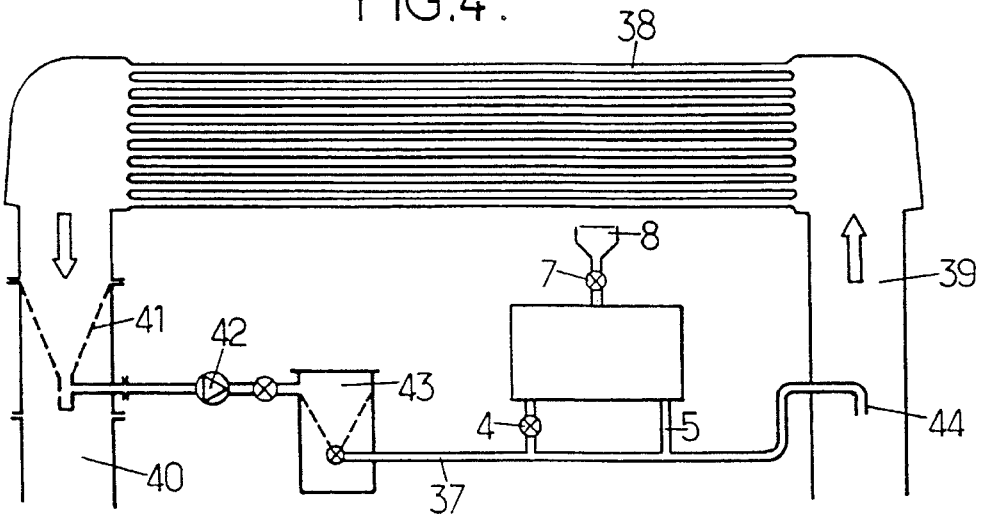
FIG. 4 is a diagram of an installation that uses balls for cleaning purposes and fitted with such apparatus.

As mentioned above, it is particularly advantageous in accordance with the invention to mount the above-described ball-impregnating assembly on the pipework 37 for recycling the balls used in an installation for cleaning the tubes 38 constituting a condenser or a heat exchanger, as shown in FIG. 4.

The tubes 38 in question form a horizontal bundle and they are fed with cold water from a duct 39 and the hot water that leaves these tubes is removed by a duct 40.

The duct 40 is fitted with a grid device 41 for recovering the cleaning balls, and the recycling pipework 37 is itself fitted with a circulation pump 42, an air lock 43 for collecting the balls when it is desired to stop circulation thereof, and then at the downstream end thereof a ball-injection nozzle 44 opening out into the inlet duct 39.

In FIG. 4, there can be seen the above-described valve 4 enabling water to be admitted into the impregnator apparatus, together with the outlet duct 5 from said apparatus and the loading hopper 8 associated with the corresponding valve 7.

In this case, the impregnated balls that leave the tank through the duct 5 are injected directly into the recirculation pipe 37 instead of being collected in the basket 21.

In preferred embodiments, the above impregnator apparatus is also associated with a ball sorter of the type constituting the subject matter of document U.S. Pat. No. 4,974,662, together with a ball counter of the kinds that are presently known.

The assembly constituted in this way enables the cleaning installation in question to be run entirely automatically.

It is recalled at this point that continuous cleaning of the tubes 38 is effective only if the diameter of the balls is greater than the inside diameter of the tubes to be cleaned and if the number of balls in circulation is sufficient to ensure that the time which elapses on average between two consecutive passes of a ball through a given tube is not too great.

The sorter of the above patent serves continuously to extract worn balls from the circuit once their diameter has become too small.

The ball counter serves continuously to keep track of the number of balls that remain in circulation: when this number of balls becomes too small for ensuring effective cleaning, i.e. once the number of missing balls has reached a pre-established threshold, said counter issues a signal indicating that a charge of new balls should be injected into the cleaning circuit.

The impregnation device described above is dimensioned as a function of the size desired for said charge of new balls, and it enables said charge to be injected into the circuit as soon as the counter calls for it.

The assembly under consideration is shown in FIG. 5.

The ball counter mounted on the recycling duct 37 is given reference 45.

The sorter 46 is mounted on the same duct immediately downstream from the counter 45.

Worn balls of a diameter that has become too small are deflected via a duct 47 towards a worn ball collector 48 whose base in the form of a truncated cone or the like is in communication with a valve 49 for disposing of worn balls.

The collector 48 is connected to the above water inlet duct 3 fitted with the valve 4.

A grid 50 mounted in the collector prevents worn balls from gaining access to said duct 3.

A shutter valve 51 mounted on said duct 3 makes it possible to provide fine adjustment of the selection performed by the sorter 46.

By using this valve 51 to adjust the flow rate of water circulating through the two ducts 47 and 3, the degree of suction exerted through the sorter on the worn balls is adjusted: the stronger the suction effect the greater the size of the threshold that needs to be reached by the shrinking diameter of the worn balls to justify replacement thereof with new balls.

It should be observed that in the embodiment of FIG. 5, the emptying valve 23 described above is not provided, with the tank 2 being capable of being emptied in this case via the valve 4, the collector 48, and the valve 49.

This assembly is operated essentially by opening and closing valves and slides and it is therefore very easily automated. It operates as follows.

When the ball counter 45 indicates that the number of balls in circulation is insufficient for providing effective cleaning of the tubes 38, i.e. when the number of missing balls has reached the alarm threshold, it triggers the following cycle of successive operations:

- the valves 52, 6, and 15 are closed and the valves 49 and 7 are opened, thereby dumping the worn balls collected in the collector 48 through the valve 49 together with the water that was contained in said collector 48 and in the tank 2;
- the top slide 24 is closed and the bottom slide 25 is opened, thereby dropping the charge of balls contained in the air lock 26 into the tank 2, after which the valves 7 and 49 and the bottom slide 25 are closed;
- the valves 52 and 15 are opened to allow the collector 48 and the tank 2 to fill with water;
- the valves 4 and 15 are closed and compressed air is then injected into the chamber C to lower the diaphragm 29 so as to create a vacuum in the tank 2 and extract air from the balls;
- the valve 4 is opened to admit water into the tank 2 and thereby impregnate the balls with water, after which the valve 15 is opened to remove the air that has been collected in the enclosure 10;
- compressed air is injected into the chamber D and the chamber C is connected to the atmosphere to return the diaphragm 29 to its high position;
- the impregnation cycle is optionally repeated at least once by imparting reciprocating motion to the diaphragm 29;
- the valve 6 is opened to inject the balls that have thus been impregnated with water into the circuit 37; and
- the top slide 24 is opened and the stirrer for stirring the balls contained in the hopper 8 is actuated to refill the air lock 26 with balls.

The assembly is then ready to perform a new sequence of the above operations, thereby automatically dumping a given charge of worn balls and inserting an equivalent charge of new balls after they have been impregnated with water.

Thus, whatever embodiment is used, apparatus is obtained that serves to impregnate the balls of a cleaning installation with water, and the structure and the implementation of that apparatus can be seen sufficiently from the above.

This apparatus has important advantages over those known in the past, and in particular the following.

It is extremely simple and robust, the grids it contains have meshes of relatively large diameter, thereby eliminating risks of the grids being clogged or damaged by the various kinds of debris that may be found in the water that entrains the balls.

It lends itself to a very high degree of automation, in particular when associated with the counting and sorting apparatus implemented in the embodiment described with reference to FIG. 5, thereby making it possible to reduce costs considerably with respect to monitoring of the cleaning installation as a whole.

Indeed, the only intervention required on the overall installation for cleaning the condenser or the like is then limited to no more than filling up the hopper 8 with new balls whenever the hopper no longer contains enough balls.

The capacity of the hopper can be large, and it need only be filled up with balls two or three times a year, thus constituting a considerable saving in labor costs compared with present installations where the balls to be injected are impregnated by hand several times a month.

In addition, because the installation as a whole is suitable for being automated, it is possible to impart a high degree of security to the operation of cleaning the condenser or the like since with this installation it is certain that at all times the balls in circulation for performing cleaning are both sufficient in number and in a state of little wear so that the effectiveness of the cleaning is high.

Naturally, and as can be seen from the above, the invention is not limited in any way to those implementations and embodiments that are described more particularly, on the contrary, the invention extends to any variant.

I claim:

1. Apparatus for impregnating spongy balls for cleaning tubes, the apparatus comprising a tank interposed between first and second valves associated respectively with a water inlet duct and with a water outlet duct, a coupling provided with a third valve connecting the top of the tank to a source of new cleaning balls, a grid having a mesh that is too small to allow the balls to pass disposed inside the tank in such a manner as to define an upper chamber at the top of the tank which is inaccessible to the balls, a duct fitted with a fourth valve connecting said chamber to an outlet, and a device suitable for generating a pressure reduction in said chamber, said device for generating a pressure reduction comprising a pump having two compartments separated by a moveable member, one of said compartments being in fluid communication with said upper chamber whereby, when the first, second, third and fourth valves are all closed, movement of said moveable member in a first direction causes an increase in the volume defined by the inside of said tank and by the spaces in fluid communication with the inside of the tank and movement of said moveable member in a second direction, opposite to said first direction, eliminates the increase in said volume, said apparatus further comprising means for moving said moveable member in said first and second directions.

2. Apparatus according to claim 1, wherein the pump comprises a diaphragm pump whose moveable member constitutes the bottom of the tank.

3. Apparatus according to claim 1, further comprising a vertical chimney that is laterally defined by a grid, the chimney passing through said upper chamber and extending downwardly below the coupling between the tank and the third valve, and a float disposed beneath said chimney in such a manner to prevent balls contained in the tank from moving back up inside said chimney.

4. An apparatus comprising tubes and tube-cleaning apparatus for cleaning the tubes by cleaning balls, said cleaning apparatus comprising pipework and means for circulating a flow of liquid carrying cleaning balls through the tubes and the pipework the improvement wherein the cleaning apparatus comprises a tank interposed between first and second valves associated respectively with a water inlet duct and with a water outlet duct, a coupling provided with a third valve connecting the top of the tank to a source of new cleaning balls, a grid having a mesh that is too small to allow the balls to pass disposed inside the tank in such a manner as to define an upper chamber at the top of the tank which is inaccessible to the balls, a duct fitted with a fourth valve connecting said chamber to an outlet, and a device suitable for generating a pressure reduction in said chamber, said device for generating a pressure reduction comprising a pump having two compartments separated by a moveable member, one of said compartments being in fluid communication with said upper chamber whereby, when the first, second, third and fourth valves are all closed, movement of said moveable member in a first direction increases the volume defined by the inside of said tank and by the spaces in fluid communication with the inside of the tank, and movement of said moveable member in a second direction, opposite to said first direction, eliminating the increase in said volume, said apparatus further comprising means for moving said moveable member in said first and second directions.

5. Apparatus according to claim 4, further comprising a ball sorter, means for removing worn balls from the cleaning apparatus, means for inserting into said cleaning apparatus a charge of new balls impregnated with water, and means for automatically operating the cleaning apparatus.

6. A method of impregnating spongy balls for cleaning tubes comprising:

providing apparatus for impregnating spongy balls for cleaning tubes, the apparatus comprising a tank interposed between first and second valves associated respectively with a water inlet duct and with a water outlet duct, a coupling provided with a third valve connecting the top of the tank to a source of new cleaning balls, a grid having a mesh that is too small to allow the balls to pass disposed inside the tank in such a manner as to define an upper chamber at the top of the tank which is inaccessible to the balls, a duct fitted with a fourth valve connecting said chamber to an outlet, and a device suitable for generating a pressure reduction in said chamber, said device for generating a pressure reduction comprising a pump having two compartments separated by a moveable member, one of said compartments being in fluid communication with said upper chamber whereby, when the first, second, third and fourth valves are all closed, movement of said moveable member in a first direction causes an increase in the volume defined by the inside of said tank and by the spaces in fluid communication with the inside of the tank, and movement of said moveable member in a second direction, opposite to said first direction, eliminates the increase in said volume, said apparatus further comprising means for moving said moveable member in said first and second directions, with the first and second valves closed and the third and fourth valves open, inserting a charge of new balls into the tank through the third valve;

then, with the second and third valves closed and with the first and second valves open, admitting water into the tank until it has been completely filled with water;

then, with all four valves closed, moving the moveable member in said first direction to increase said volume thereby subjecting said volume to a reduction in pressure and emptying from the balls at least part of the air contained therein, opening the first and fourth valves so as to impregnate with water the balls that have been at least partially emptied of air; and moving the moveable member in said second direction to return it to its initial position.

7. An impregnation method according to claim 6, wherein the volumetric capacity of the pump is greater than four times the volume, at atmospheric pressure, of air contained in the cells of said new charge of balls.

* * * * *